US005614142A

United States Patent [19]

Lilly et al.

[11] Patent Number: 5,614,142

[45] Date of Patent: Mar. 25, 1997

[54] PROCESS FOR SPINNING THERMOPLASTIC FIBERS ON A GRID SPINNING SYSTEM

[75] Inventors: Robert L. Lilly, Asheville; Robert H. Blackwell, Candler; Charles H. Rogers, Asheville; Zachary G. Shoaf, Canton, all of N.C.

[73] Assignee: BASF Corporation, Mt. Olive, N.J.

[21] Appl. No.: 559,863

[22] Filed: Nov. 20, 1995

[51] Int. Cl.[6] ..... D01F 1/02; D01F 1/10

[52] U.S. Cl. ..... 264/211

[58] Field of Search ..... 264/211, 349

[56] References Cited

U.S. PATENT DOCUMENTS

| | | | |
|---|---|---|---|
| 2,217,743 | 10/1940 | Greenewalt | 425/449 |
| 2,683,073 | 7/1954 | Pierce | 264/85 |
| 3,102,301 | 9/1963 | Dechene | 264/411 |
| 3,829,543 | 8/1974 | Robertson | 264/78 |
| 3,923,727 | 12/1975 | Jost et al. | 524/171 |
| 4,379,913 | 4/1983 | Waitkus | 528/300 |
| 4,405,734 | 9/1983 | Fuchs et al. | 524/90 |
| 4,453,867 | 6/1984 | Sharps | 366/98 |
| 4,490,542 | 12/1984 | Iqbal et al. | 548/453 |
| 4,639,205 | 1/1987 | Lim | 425/200 |
| 5,157,067 | 10/1992 | Burditt et al. | 524/270 |
| 5,364,582 | 11/1994 | Lilly | 264/211 |

*Primary Examiner*—Leo B. Tentoni

[57] ABSTRACT

Fibers are made from thermoplastic polymers by supplying solid particles of the thermoplastic to a melting grid; heating the melting grid to a temperature sufficient to melt the thermoplastic; melting the thermoplastic particles on the heated melting grid such that the melted thermoplastic flows through the grid and is collected in a collecting chamber located beneath the melting grid; injecting into the collecting chamber below the melting grid an additive present in a non-aqueous carrier which carrier comprises organic rosin materials and a surfactant; without actuated mechanical stirring, forming a substantially homogeneous mixture from the injected additive; and extruding fibers from the substantially homogeneous mixture.

5 Claims, No Drawings

PROCESS FOR SPINNING THERMOPLASTIC FIBERS ON A GRID SPINNING SYSTEM

FIELD OF THE INVENTION

The present invention relates generally to spinning thermoplastic fibers on a grid spinning system. More specifically, the present invention relates to processes for introducing additives into the thermoplastic melt of a grid spinning system.

BACKGROUND OF THE INVENTION

As used herein, the term "fibers" or "fiber" refers both to filaments (strands of indefinite or continuous length) and staple (strands of short and definite length).

There are several general methods for extruding thermoplastic polymers into fibers. One of these methods is known as grid spinning because the solid flakes or chips of polymer are melted on a heated grid. U.S. Pat. No. 2,683,073 to Pierce and U.S. Pat. No. 3,102,301 to Dechene describe conventional grid spinning processes.

In the manufacture of fibers, it is sometimes desirable to introduce different materials into the melt in order to provide the fibers with certain functional characteristics. For example, $TiO_2$ is sometimes added to the polymer melt to deluster the resulting fiber. There are several methods for adding such additives to the grid spinning fiber extrusion process. The solid polymer chips or flakes may be dusted with the additive prior to melting the chips or flakes on the grid. One such dusting process is described in U.S. Pat. No. 4,490,542 to Iqbal et at. Similarly, U.S. Pat. No. 4,379,913 to Waitkus describes adding antistatic agents from a solvent solution to chips or flakes of polymer, drying the coated polymer chips or flakes and spinning the dried coated polymer chips or flakes to yam by, for example, melting on a grid into a stirred pool. U.S. Pat. No. 3,923,727 to Jost et al. describes sprinkling chips with finely divided dye stuff and then melting the chips according to usual grid spinning processes.

Another method for introducing additives is to mix solid additive concentrate pellets with the host polymer chips or flakes. U.S. Pat. No. 3,829,543 to Robertson describes a process for mixing pellets of a coloring additive with chips of the host polymer prior to melting.

Incidentally, another method for melt spinning is to melt the polymer chips in a screw extruder. Additives may be added directly to the extruder, often using a sidearm of the extruder. U.S. Pat. No. 4,405,734 to Fuchs et al. describes a process wherein dye stuff can be metered directly into the melt of the thermoplastic via a side screw to achieve homogeneous mixing or using a coiled grid spinning system. Generally, screw extrusion processes result in fairly homogeneous mixtures of the additives in the melt due to the mixing action of the screw. Grid melting systems suffer in this regard because the melting process itself is without agitation.

The lack of agitation has been recognized to cause certain problems such as gel formation and spherulite seeding due to unmelted particles. Equipping the grid with mechanical stirring is one method of providing homogeneity in the melt. U.S. Pat. No. 4,453,867 to Sharps describes a disc stirring apparatus for grid melting systems. U.S. Pat. No. 4,639,205 to Lim describes a shaft impeller for grid melting systems.

U.S. Pat. No. 5,157,067 to Burditt et al. describes a liquid concentrate system that may be incorporated into fibers. U.S. Pat. No. 5,364,582 to Lilly describes the use of the liquid concentrate described in U.S. Pat. No. 5,157,067 to introduce antistatic agents into the throat of a fiber spinning extruder.

Not all grid spinning equipment is, however, equipped with agitation means. There remains a need for homogeneously introducing additives into generally unagitated grid melting systems.

SUMMARY OF THE INVENTION

Accordingly, the present invention is a process for making fibers from thermoplastic polymers comprising supplying solid particles of the thermoplastic to a melting grid; heating the melting grid to a temperature sufficient to melt the thermoplastic; melting the thermoplastic particles on the heated melting grid such that the melted thermoplastic flows through the grid and is collected in a collecting chamber located beneath the melting grid; injecting into the collecting chamber below the melting grid an additive present in a non-aqueous carder which carder comprises organic rosin materials and a surfactant; without actuated mechanical stirring forming a substantially homogeneous mixture from the injected additive; and extruding fibers from the substantially homogeneous mixture.

It is an object of the present invention to introduce additives into a generally unagitated melt reservoir of a grid spinning system.

Related objects and advantages will become apparent to the ordinarily skilled after reading the following detailed description.

DETAILED DESCRIPTION OF THE PREFERRED EMBODIMENTS

To promote an understanding of the principles of the present invention, descriptions of specific embodiments of the invention follow and specific language describes the same. It will nevertheless be understood that no limitation of the scope of the invention is thereby intended, and that such alterations and further modifications, and such further applications of the principles of the invention as discussed are contemplated as would normally occur to one ordinarily skilled in the art to which the invention pertains.

As noted, not all grid spinning equipment has mechanical agitation capabilities. Therefore, the present invention is a process for introducing additives into a generally unagitated melt reservoir of a grid spinning system and thereafter spinning fibers which display substantial homogeneity of the characteristic imparted. The process involves supplying solid particles of a thermoplastic to a melting grid having a molten polymer reservoir beneath the grid. The melting grid is heated to a temperature sufficient to melt the thermoplastic such that the melted thermoplastic flows through the grid and is collected in the collecting chamber (melt reservoir) located beneath the grid. The additive in its carder is injected into the collecting chamber below the melting grid. The additive is present in a non-aqueous carrier which comprises organic rosin materials and at least one surfactant. Following the injection of the additive, a substantially homogeneous mixture forms and, subsequently, is extruded into fibers.

The process of the present invention may be practiced with any conventional grid spinning apparatus with or without mechanical agitation. One such conventional melt grid spinning apparatus is described in U.S. Pat. No. 2,217, 743 which is incorporated herein by reference. Preferably, the additive is injected into the reservoir using the apparatus described in co-owned and copending application Serial No. 08/557,802 filed Nov. 20, 1995.

The method of the present invention is useful with any suitable thermoplastic polymer to be extruded, such as polyamides, polyesters, polyethylene and polypropylene. This invention is particularly useful with polyamide polymers. Examples of useful polyamide polymers are nylon 6, nylon 12, nylon 6,6, nylon 6T and various copolymers thereof. Such thermoplastics are generally supplied in the form of powders, chips, or granules.

The melting grid will be heated to a temperature sufficient to melt the thermoplastic polymer being extruded. In the case of nylon 6, this temperature is generally between 260° C. and 285° C.

Additives which may be added according to the present invention include a variety of additives such as pigments, antistatic agents, delusterants, flame retardants, heat stabilizers, light stabilizers, dye regulating agents and combinations thereof. It is especially preferred to add pigment by the process of the present invention because colorants are particularly sensitive to concentration gradients in the melt. Such gradients will appear as streaks in the woven, knit or tufted articles made form fibers extruded from such a melt. The present invention permits addition of pigments to the gxid without creating streaks in the final articles.

One especially advantageous use of the present invention is for hosiery yam or other yam which is typically dyed after extrusion. The use of dyebaths and other after extrusion dyeing methods leads to waste and environmental contamination. Melt coloration eliminates the waste from dyebaths, etc.

The final yam product is preferably 15 to 100 total denier with a denier per filament of from 2 to 15. The final fiber product can be treated like any fiber of the same general type and processed (e.g., drawn, textured, etc.) according to known conventional processes.

The invention will be described by reference to the following detailed examples. The examples are set forth by way of illustration, and are not intended to limit the scope of the invention. In the following examples, the following test procedures were used:

RV: Relative viscosity is measured in $H_{SO4}$.

Tenacity and Elongation: Tenacity and elongation are measured in accordance with ASTM D2256, "Standard Test Method for Tensile Properties of Yams by the Single-Strand Method."

Evenness: Evenness is measured using ASTM D1425, "Uneveness of Textile Strands Using Zellweger Uster Capacitance Testing Equipment."

Superloft: Superloft is measured using ASTM D4031–81, "Standard Test Method For Bulk Properties Of Textured Yarns."

% Carbon Black: % Carbon black is measured using standard nephelometric methods. A Milton-Roy 21 DUV spectrophotometer is used at a wave length of 450 nm.

ACS Color Value: ACS color value is measured using AATCC Test Method 153–1985. An ACS 500-Spectro Sensor II is used and instructions in the operators' handbook are followed.

EXAMPLES A–D

A liquid color concentrate is formulated as described in U.S. Pat. No. 5,157,067. This color concentrate contains 40 wt % carbon black.

A production capacity grid spinning machine is set up to spin normal 27/5 POY nylon 6. The grid temperature is 275° C. with a spinneret output of 10.5 gms/min through a 5 hole round cross-section spinneret.

A positive-displacement gear pump is used to inject the liquid color concentrate through a circular-shaped distribution plate (with an attached injection robe) in the grid pot. The 40 wt % carbon black concentrate is added at a rate to achieve a 0.8% concentration of carbon black in the fiber. The yam (27/5 round cross-section nylon partially oriented yam) is spun at 4200 m/min. This yam is draw textured on an FK-6-S12 texturing machine available from American Bannag Corporation.

Several POY yams A–D are made from a single machine by simultaneously routing the molten polymer from the grid pot through four spinnerets. The four yams are evaluated for various properties as shown in Table 1.

TABLE 1

| Example | RV | Denier | Tenacity (g/den) | Elongation (%) | Evenness (% CV) |
|---|---|---|---|---|---|
| A | 2.89 | 27.09 | 4.10 | 79.8 | 0.55 |
| B | 2.90 | 27.16 | 3.97 | 77.4 | 0.62 |
| C | 2.92 | 27.51 | 3.89 | 75.6 | 0.72 |
| D | 2.89 | 27.10 | 3.95 | 77.2 | 0.88 |

These yarns are each draw textured and found to be suitable as textile yarns, e.g., hosiery yam. These yarns are evaluated for various properties and the results are shown in Table 2.

TABLE 2

| Example | Denier | Tenacity (g/den) | Elongation (%) | Evenness (% CV) | Superloft (%) |
|---|---|---|---|---|---|
| A | 20.41 | 4.70 | 26.0 | 0.75 | 70.8 |
| B | 20.37 | 4.66 | 25.5 | 0.55 | 71.2 |
| C | 20.19 | 4.71 | 25.7 | 0.90 | 66.8 |
| D | 20.93 | 4.58 | 26.5 | 1.02 | 68.8 |
| Control* | 19.35 | 4.71 | 27.6 | 0.60 | 67.6 |

*Control is 20/5 delustered round cross-section from standard production textured yarn (without carbon black concentrations) processed under same conditions as examples A–D except at lower draw ratio (1.26 versus 1.38 for the invention examples).

To assess color uniformity of the color in the melt, the color of yarn from each example is measured. The results are presented in Table 3.

TABLE 3

| Example | % Carbon Black in Yarn | ACS Color (CIE Lab) L Value* |
|---|---|---|
| A | 0.79 | 14.5 |
| B | 0.75 | 14.2 |
| C | 0.76 | 14.3 |
| D | 0.82 | 14.8 |

*Value represents average of 4 readings on each sample A–D.

What is claimed is:

1. A process for making fibers from thermoplastic polymers comprising:

(a) supplying solid particles of thermoplastic polymer to a melting grid;

(b) heating the melting grid to a temperature sufficient to melt the thermoplastic polymer particles;

(c) melting the thermoplastic polymer particles on the heated melting grid such that the melted thermoplastic polymer flows through the grid and is collected in a collecting chamber located beneath the melting grid;

(d) injecting into the melted thermoplastic polymer present in the collecting chamber below the melting grid an additive present in a non-aqueous carrier which carrier comprises organic rosin materials and a surfactant;

(e) without actuated mechanical stirring, forming in the collecting chamber a substantially homogeneous mixture of the injected additive and the melted thermoplastic polymer; and (f) extruding fibers from the substantially homogenous mixture.

2. The process of claim 1 wherein in said injecting the additive is a pigment dispersed in a non-aqueous carrier.

3. The process of claim 1 wherein the thermoplastic polymer is selected from the group consisting of:

nylon 6;

nylon 6,6;

nylon 12;

nylon 6T; and copolymers thereof.

4. The process of claim 1 wherein the melting grid is heated in the range of about 260° C. to about 285° C.

5. The process of claim 1 wherein said extruding is of fibers with a denier per filament of 2 to 15.

* * * * *

UNITED STATES PATENT AND TRADEMARK OFFICE

CERTIFICATE OF CORRECTION

PATENT NO. : 5,614,142

DATED : March 25, 1997

INVENTOR(S) : Lilly et al.

It is certified that error appears in the above-indentified patent and that said Letters Patent is hereby corrected as shown below:

At column 3, line 44, please delete "$H_{SO4}$" and insert $H_2SO_4$ in its place.

At column 3, line 59, please delete "500" after "ACS" and replace it with "4500".

Signed and Sealed this

First Day of July, 1997

Bruce Lehman

*Attest:*

*Attesting Officer*

BRUCE LEHMAN

*Commissioner of Patents and Trademarks*